US005378292A

United States Patent [19]

Miller et al.

[11] Patent Number: 5,378,292

[45] Date of Patent: Jan. 3, 1995

[54] PHOSPHATE CONVERSION COATING AND COMPOSITIONS AND CONCENTRATES THEREFOR WITH STABLE INTERNAL ACCELERATOR

[75] Inventors: Robert W. Miller, Clarkston; Michael Petschel, Rochester, both of Mich.

[73] Assignee: Henkel Corporation, Plymouth Meeting, Pa.

[21] Appl. No.: 167,755

[22] Filed: Dec. 15, 1993

[51] Int. Cl.[6] ..... C23C 22/07

[52] U.S. Cl. ..... 148/259; 148/260; 148/261; 148/262; 106/14.12; 106/14.44

[58] Field of Search ..... 148/259, 260, 261, 262; 106/14.12, 14.44

[56] References Cited

U.S. PATENT DOCUMENTS

| | | | |
|---|---|---|---|
| 3,181,976 | 5/1965 | Yager | 148/259 |
| 3,625,777 | 12/1971 | Okabe et al. | 148/259 |
| 3,723,334 | 3/1973 | Maurer | 252/181 |
| 4,824,490 | 4/1989 | Oei et al. | 148/259 |
| 4,865,653 | 9/1989 | Kramer | 204/38.1 |
| 5,000,799 | 3/1991 | Miyawaki | 148/259 |
| 5,039,361 | 8/1991 | Hauffe et al. | 148/259 |

FOREIGN PATENT DOCUMENTS

| | | | |
|---|---|---|---|
| 969077 | 10/1975 | Canada | 148/259 |
| 0013328 | 7/1980 | European Pat. Off. | 148/259 |
| 0554179 | 8/1993 | European Pat. Off. | 148/259 |
| 2506349 | 8/1976 | Germany | 148/259 |
| 1955002 | 12/1977 | Germany . | |
| 59-020474 | 2/1984 | Japan | 148/259 |
| 4-32576 | 2/1992 | Japan | 148/259 |

*Primary Examiner*—Anthony Green

*Attorney, Agent, or Firm*—Law Dept., Hemkel Corp.; Ernest G. Szoke; Wayne C. Jaeschke; Norvell E. Wisdom, Jr.

[57] ABSTRACT

The following water soluble materials are all satisfactory internal accelerators for otherwise conventional zinc phosphate conversion coating solutions: reducing sugars, starch, urea, and poly{acrylates and methacrylates}. Concentrates including these ingredients and otherwise conventional constituents of zinc phosphate conversion coating compositions, except for excluding conventional accelerators other than nitrate, are stable in composition during storage, unlike most conversion coating compositions containing conventional accelerators. Thus concentrates according to the invention are practical single-package concentrates that can be made into working phosphating compositions by dilution with water only.

20 Claims, No Drawings

PHOSPHATE CONVERSION COATING AND COMPOSITIONS AND CONCENTRATES THEREFOR WITH STABLE INTERNAL ACCELERATOR

BACKGROUND OF THE INVENTION

1. Field of the Invention

This invention relates to compositions and processes for depositing zinc phosphate containing conversion coatings on metal surfaces, particularly the surfaces of iron, steel, galvanized steel and other zinciferous surfaces, and aluminum and its alloys that contain at least 45% by weight of aluminum. The invention particularly relates to concentrated compositions containing all the active ingredients required for a working conversion coating composition, including an "internal" accelerator, i.e., an accelerator that is stable when a composition containing the accelerator and all other active ingredients required for a working phosphating composition is stored.

2. Statement of Related Art

The general process of zinc phosphate conversion coating is well known in the art: Contact of active metals with aqueous acidic compositions containing zinc and phosphate ions results in the deposition on the active metal surfaces of a conversion coating containing zinc phosphate. If the active metal is ferrous, iron phosphates are usually included in the coating, and in modern practice nickel and/or manganese are often included in the coating composition and thereby in the coating formed. In order to speed the process and improve the uniformity of the coating, it is customary to include in the coating composition a component called an "accelerator" that does not usually become incorporated into the coating formed. Typical widely used accelerators include nitrate and nitrite ions, chlorate, soluble nitroaromatic organic compounds such as p-nitrobenzene sulfonic acid, and hydroxylamine.

The most widely used accelerator in current commercial practice is believed to be nitrite, but this material suffers from chemical instability, so that it can not satisfactorily be incorporated into concentrated compositions or concentrates that contain most or all of the other ingredients needed for a zinc phosphate conversion coating, are widely available from several commercial sources, and are diluted with water before use to provide a working solution. When nitrite acceleration is desired, a separate addition of nitrite to the working solution must be made, and this is considered inconvenient by many users. A single package concentrate is highly desirable commercially.

It is generally known that some of the ingredients of working zinc phosphate conversion coating forming liquid compositions are consumed by incorporation into the phosphate coatings formed, and in general some ingredients are so consumed in different proportions from those that prevail in the conversion coating forming liquid composition. Therefore, if an initial volume of optimal working composition is used to phosphate extensive amounts of metal surface per unit volume of the initial working composition, at least some of the ingredients will need to be replenished in order for the liquid composition to continue to function as desired. Compositions called "replenisher concentrates" or simply "replenishers" are known for this purpose in the art, and generally contain most if not all of the same ingredients as a concentrate composition to be used as described above in making up a fresh working solution, but often in different proportions. The composition of an optimal replenisher is dependent on a variety of factors, including the metal or mixture of metal types being phosphated, the initial bath composition, the amount of drag-out of phosphating composition into subsequent stages of treatment, and the amount of sludge formed in the phosphating composition.

Accordingly, one object of this invention is to provide a single package concentrate, which may be denoted a "make-up concentrate", that gives, after appropriate dilution, a working composition for zinc phosphate conversion coating that produces coatings at least as high in quality, at a speed of coating that is at least as high, as the coating quality and speed achieved from working compositions with nitrite accelerators, with other ingredients than the accelerator the same or similar to those of the compositions according to this invention. Another object is to provide a single package replenisher concentrate that is suitable for replenishing a working composition as described above, after the latter has been used to coat an extensive area of metal surface compared to the volume of the working composition. Other objects will be apparent from the description below.

DESCRIPTION OF THE INVENTION

Except in the claims and the operating examples, or where otherwise expressly indicated, all numerical quantities in this description indicating amounts of material or conditions of reaction and/or use are to be understood as modified by the word "about" in describing the broadest scope of the invention. Practice within the numerical limits stated is generally preferred. Also, unless expressly stated to the contrary: percent, "parts of", and ratio values are by weight; the description of a group or class of materials as suitable or preferred for a given purpose in connection with the invention implies that mixtures of any two or more of the members of the group or class are equally suitable or preferred; description of constituents in chemical terms refers to the constituents at the time of addition to any combination specified in the description, and does not necessarily preclude chemical interactions among the constituents of a mixture once mixed; specification of materials in ionic form implies the presence of sufficient counterions to produce electrical neutrality for the composition as a whole; any counterions thus implicitly specified should preferably be selected from among other constituents explicitly specified in ionic form, to the extent possible; otherwise such counterions may be freely selected, except for avoiding counterions that act adversely to the stated objects of the invention. Also, the term "mole" may be applied to ionic and elemental as well as molecular constituents, and the term "polymer" includes "oligomer".

SUMMARY OF THE INVENTION

It has been found that the following materials are all satisfactory internal accelerators for otherwise conventional zinc phosphate conversion coating solutions: reducing sugars, preferably dextrose and galactose; water soluble starch; urea; and poly{acrylates and methacrylates}, i.e., polymers in which at least 50% of the polymer is made up of one or more moieties with one of the formulas:

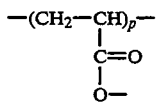

or

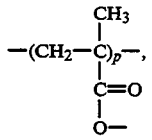

where p is an integer with a value of at least 10.

Various embodiments of the invention include working compositions for direct use in treating metals, make-up concentrates from which such working compositions can be prepared by dilution with water, replenisher concentrates suitable for maintaining optimum performance of working compositions according to the invention, processes for treating metals with a composition according to the invention, and extended processes including additional steps that are conventional per se, such as cleaning, activation with titanium phosphate sols (Jernstedt salts), rinsing, and subsequent painting or some similar overcoating process that puts into place an organic binder containing protective coating over the metal surface treated according to a narrower embodiment of the invention. Articles of manufacture including surfaces treated according to a process of the invention are also within the scope of the invention.

DESCRIPTION OF PREFERRED EMBODIMENTS

For a variety of reasons, it is sometimes preferred that compositions according to the invention as defined above should be substantially free from many ingredients used in compositions for similar purposes in the prior art. Specifically, when maximum storage stability of a concentrate is desired, it is preferred, with increasing preference in the order given, independently for each preferably minimized component listed below, that these compositions contain no more than 25, 15, 9, 5, 3, 1.0, 0.35, 0.10, 0.08, 0.04, 0.02, 0.01, 0.001, or 0.0002, percent of each of the following constituents: nitrite, chlorate, chloride, bromide, iodide, organic compounds containing nitro groups, hexavalent chromium, manganese in a valence state of four or greater, peroxy compounds, ferricyanide; ferrocyanide; and pyrazole compounds. In contrast, in working solutions, additional accelerator components such as those included in this list have no known detrimental effect, but are generally not needed, and their absence may therefore be preferred for economic reasons.

Preferably make-up concentrate compositions according to this invention are aqueous liquids that comprise, more preferably consist essentially of, or most preferably consist of water and the following dissolved components:

(A) with increasing preference in the order given, at least 35, 150, 200, 220, 235, or 245 grams per kilogram of total composition (hereinafter often abbreviated as "g/kg") and independently, with increasing preference in the order given, not more than 825, 700, 600, 500, or 450 g/kg of phosphate ions;

(B) zinc cations in such an amount that the ratio of phosphate ions to zinc ions is, with increasing preference in the order given, at least 3:1, 5:1, 7.0:1.0, 8.5:1.0, 10.0:1.0, or 11.0:1.0 and, independently, with increasing preference in the order given the ratio of phosphate ions to zinc ions is not greater than 100:1, 50:1, 35:1, 20:1, or 14:1.0;

(C) an amount of internal accelerator as described above including at least one of:

(C.1) with increasing preference in the order given, at least 0.10, 0.25, 0.30, 0.38, 1.0, 4.0, 8.0, 16.0, 25, 30, or 35 g/kg, and independently, with increasing preference in the order given, not more than 550, 425, 300, 200, or 175 g/kg, of an internal accelerator selected from the group consisting of reducing sugars, starch, and urea;

(C.2) at least 0.0005, more preferably at least 0.0014, and independently, with increasing preference in the order given, not more than 1.0, 0.5, 0.20, 0.10, 0.07, 0.04, 0.02, 0.015, or 0.010, g/kg of acrylate and methacrylate polymers, most preferably polyacrylic acid; and (D) an amount of acid such that a solution of 6% of the concentrate in deionized water will have, with increasing preference in the order given, at least 1.0, 2.5, 3.5, 4.3, 5.0, or 5.3, but, independently, with increasing preference in the order given, not more than 40, 34, 29, 25, 22, 20, 18, 16, 13.5, or 12.9, points of free acid; and, independently, with increasing preference in the order given, will have at least 3.5, 7.0, 10, 13, 15, or 16.5 but, independently, with increasing preference in the order given, not more than 70, 57, 47, 42, 39, 37, or 36 points of total acid; and, optionally but preferably, (E) an amount of manganese (II) cations such that the ratio of the manganese cations to the zinc cations is within the range, with increasing preference in the order given, from 1:10 to 5:1, 1.0:7.0 to 3.0:1.0, 1.0:4.0 to 1.5:1.0, or 1.0:2.4 to 1.0:1.0; and, optionally but preferably, (F) at least one of:

(F.1) an amount of divalent cations selected from the group consisting of nickel, cobalt, and magnesium cations such that the ratio of the total of these divalent cations to the zinc cations is within the range, with increasing preference in the order given, from 1:5 to 5:1, 1.0:4.0 to 3.0:1.0, 1.0:2.0 to 1.8:1.0, or 1.0:1.4 to 1.2:1.0;

(F.2) an amount of divalent copper cations such that the ratio of the copper cations to the zinc cations is within the range, with increasing preference in the order given from 0.0025:5 to 0.5:1, 0.0030:4.0 to 0.30:1.0, 0.004:2.0 to 0.18:1.0, or 0.010:1.4 to 0.12:1.0; and, optionally but preferably, (G) with increasing preference in the order given, at least 1.0, 1.5, 1.9, 2.2, or 2.4 g/kg, but, independently, with increasing preference in the order given, not more than 50, 21, 17, 14, 11, 9.3, or 7.5, g/kg of complex fluoride ions, independently preferably selected from the group consisting of fluosilicate, fluotitanate, fluoborate, and fluozirconate ions, most preferably fluosilicate ions; and, optionally but preferably, (H) with increasing preference in the order given, at least 0.4, 1.1, 1.7, 2.0, 2.2, 2.4, 2.6, or 2.7 g/kg, but, independently, with increasing preference in the order given, not more than 20, 10, 6, 4.6, 3.9, 3.4, 3.1, or 2.9, g/kg of dissolved fluoride ions derived from hydrofluoric acid and/or alkali metal and ammonium fluorides and bifluorides, preferably from hydrofluoric acid; and, optionally, (J) with increasing preference in the order given, not more than 200, 100, 85, 70, 60, 55, 50, or 45 g/kg of nitrate ions.

"Points" of free acid for the purpose of the description herein are defined as equal to the number of milliliters ("mL") of 0.1N strong alkali (such as sodium hydroxide) required to titrate a 10.0 mL sample of the composition to an end point with bromcresol green indicator; for points of total acid, the titration is otherwise the same, but to an end point with phenolphthalein indicator.

It should be understood that the various components identified by letters above need not necessarily all be supplied from distinct chemical sources. For example, nickel nitrate may be used as a source of both nickel and nitrate ions, and the preferred source of phosphate ions is generally commercial concentrated phosphoric acid, which supplies at least part of the free and total acidity as well as the phosphate ions. (Phosphoric and condensed phosphoric acids and any anions produced by the ionization thereof are all to be understood for purposes of this description as providing their stoichiometric equivalent of phosphate ions, irrespective of the actual degree of ionization in the composition. Similarly, fluorine containing ions and acids that are not part of well characterized complex anions with metallic or metalloid elements are to be understood as supplying their entire stoichiometric equivalent of fluoride ions as part of component (H) as specified above.)

Preferably the concentrates are stable to storage in the temperature range from at least −20° to 50°, or more preferably to 80, °C. Stability may conveniently be evaluated by measuring the free acid and total acid contents as described above. If these values have not changed after storage by more than 10% of the their value before storage, the concentrate is considered storage stable. With increasing preference in the order given, the concentrates according to the invention will be storage stable as thus defined after storage for 1, 3, 10, 30, 60, or 200 days.

A working composition according to the invention preferably has the same necessary and optional constituents as specified above for make-up concentrates, but preferably, except for free and total acid points and possibly for internal accelerators as discussed further below, in such an amount as to give the working composition a concentration of, with increasing preference in the order given, from 0.5 to 20, 1.0 to 10, 1.5 to 7.5, 2.8 to 6.8, or 3.4 to 6.2, % of the make-up concentrate composition. Free and total acid points in a working composition preferably have the same values as described above for 6% solutions of the make-up concentrate compositions.

It has been found that acrylate and methacrylate polymers are better internal accelerators at low concentrations than at high ones, as indicated by the numbers given above as upper limits for these constituents. As little as 0.0006 g/kg of polymer in a working solution has been found to be fully satisfactory, and still lower values are workable, while concentrations of these polymers higher than 0.06 g/kg of working solution are nearly to totally ineffective in providing satisfactory coatings in the absence of other internal accelerators. On the other hand, reducing sugars have been found to be satisfactory over very wide limits from 0.026 to 10 g/kg of working solution and are workable at even lower and higher concentrations, and urea and starch are also workable over a broad range. Thus these constituents may satisfactorily be used in working solutions at concentrations that correspond to concentrations that might exceed the solubility limit in make-up concentrates, and to that extent may be an exception to the concentration preferences for working solutions given above. The principal reason for preferring higher initial concentrations of these internal accelerators that work over a wide range of concentrations is that when the initial concentration is high, even extensive depletion of the accelerator will not substantially impair the effectiveness of the compositions in providing good quality phosphate conversion coatings. For this reason, these internal accelerators that work well over a very wide concentration range are generally preferred over the acrylate and methacrylate polymers, which are most effective at very low concentrations. Reducing sugars, especially dextrose and galactose, are most preferred for this reason, with urea and starch slightly less preferred within this group but still better in this respect than the acrylate and methacrylate polymers.

In addition to or instead of the concentrations of complex and other fluorides specified above for working compositions according to the invention, it is often preferred to control the effectiveness of these solutions by measurement of a value called "fluoride activity". As this term is used herein, it is defined and measured relative to a 120E Activity Standard Solution commercially available from the Parker+Amchem ("P+A") Division of Henkel Corporation, with the aid of a fluoride sensitive electrode by a procedure described in detail in P+A Technical Process Bulletin No. 968. The Orion TM Fluoride Ion Electrode and the reference electrode provided with the Orion TM instrument are both immersed in the noted Standard Solution and the millivolt meter reading is adjusted to 0 with a Standard Knob on the instrument, after waiting if necessary for any drift in readings. The electrodes are then rinsed with deionized or distilled water, dried, and immersed in the sample to be measured, which should be brought to the same temperature as the noted Standard Solution had when it was used to set the meter reading to 0. The reading of the electrodes immersed in the sample is taken directly from the millivolt (hereinafter often abbreviated "mv" or "mV") meter on the instrument. With this instrument, lower positive mv readings indicate higher fluoride activity, and negative mv readings indicate still higher fluoride activity than any positive readings, with negative readings of high absolute value indicating high fluoride activity. The mv readings can be convened to corresponding values of activity in ppm by calibration curves supplied with the instrument. In working compositions according to this invention, fluoride activity levels are preferably within the range from 50 to 2500, more preferably from 100 to 1500, or still more preferably from 200 to 1200 ppm, especially if the working composition is to be used on an aluminum substrate.

Nitrate ions are not required in compositions according to this invention, but may be used if desired. Compositions including nitrate usually give at least slightly faster phosphating than compositions without nitrate.

For replenisher concentrates, the preferred compositions are the same as shown above for make-up concentrates, except as follows:

the ratio of phosphate ions to zinc ions is, with increasing preference in the order given, at least 1:1, 2.5:1, 3.0:1.0, 3.5:1.0, 4.0:1.0, 4.3:1.0, 4.6:1.0 or 4.9:1.0 and, independently, with increasing preference in the order given the ratio of phosphate ions to zinc ions is not greater than 35:1, 20:1, 14:1.0, 9.0:1.0, 7.5:1.0, 6.5:1.0, 5.8:1.0, or 5.4:1.0;

the concentration of component (C.1) when used is, with increasing preference in the order given, at least 0.10, 0.25, 0.30, 0.38, 1.0, 4.0, 5.5, 6.7, 7.7, 8.4, 8.8, 9.2, 9.5, or 9.7 g/kg, and independently, with increasing preference in the order given, not more than 175, 80, 40, 25, 20, 16, 13, or 11 g/kg the ratio of the manganese cations to the zinc cations is within the range, with increasing preference in the order given, from 1:10 to 2:1, 1.0:7.0 to 1.0:1.0, 1.0:5.0 to 0.75:1.0, or 1.0:4.0 to 1.0:2.0;

the ratio of the total of divalent cations selected from the group consisting of nickel, cobalt, and magnesium cations to the zinc cations is within the range, with increasing preference in the order given, from 0.05:1 to 1.5:1, 0.07:1 to 0.8:1, 0.10:1.0 to 0.40:1.0, 0.12:1.0 to 0.28:1.0, or 0.16:1.0 to 0.22:1.0; and a 6.0% solution of the concentrate in deionized water preferably has, with increasing preference in the order given, at least 1.0, 1.8, 2.5, 2.9, 3.2, or 3.4, but, independently, with increasing preference in the order given, not more than 10, 7, 6.0, 5.5, 5.1, 4.7, 4.4, 4.2, 4.0, or 3.9 points of free acid the concentration of dissolved fluoride ions derived from hydrofluoric acid and/or alkali metal and ammonium fluorides and bifluorides, preferably from hydrofluoric acid preferably is, with increasing preference in the order given, at least 0.4, 0.7, 1.3, 1.6, 1.8, 2.0, 2.2, or 2.3 g/kg, but, independently, with increasing preference in the order given, not more than 20, 10, 6, 4.2, 3.5, 3.0, 2.9, or 2.5, g/kg.

Processes according to the invention are preferably operated under the conditions conventional in the art for compositions that are otherwise like the compositions according to the invention, except for the substitution of a conventional amount of nitrite accelerator for the internal accelerator described for compositions according to this invention. Furthermore, in a process according to the invention that includes other steps than zinc phosphate conversion coating with a composition as described above, the other steps preferably are conventional per se.

The practice of this invention may be further appreciated by consideration of the following, non-limiting, working examples and comparisons.

CONCENTRATE COMPOSITIONS

Some preferred make-up concentrate compositions are shown in Table 1 below. The part of the composition that was not any of the ingredients shown explicitly in this Table was tap water. The first six of the examples in Table 1 are make-up concentrates, while Example 7 R is a replenisher concentrate. Samples of all of the concentrate compositions in this Table were found to be stable as defined above after storage in a freezer at about −20° C., a refrigerator at about 4° C., and an oven at about 50° C., for three days at each temperature.

TABLE 1

SOME CONCENTRATE COMPOSITIONS ACCORDING TO THE INVENTION

| Ingredient | g/kg of Ingredient in Concentrate No.: | | | | | | |
|---|---|---|---|---|---|---|---|
| | 1C | 2C | 3C | 4C | 5C | 6C | 7R |
| 75% $H_3PO_4$ in $H_2O$ | 400 | 400 | 400 | 309 | 280 | 250 | 250 |
| Zinc oxide | 31 | 31 | 18.8 | 18.7 | 24 | 29 | 45 |
| Dextrose | 41 | | | | | 41 | 10 |
| Urea | | 41 | | | | | |
| Starch | | | | 3.5 | | | |
| Galactose | | | | | 16.7 | | |
| ACCUMER TM 1510 | | | 0.04 | | | | |
| Manganese(II) oxide | 15 | 15 | 15 | 11 | | 15 | 15 |
| $Ni(NO_3)_2$ in $H_2O$ (13.9% nickel) | 150 | 150 | | | | | 50 |
| $MG(OH)_2$ | | | | | 8.3 | | |
| $Co(NO_3)_2$ in $H_2O$ (13.0% cobalt) | | | | 34 | | | |
| $CuSO_4 . H_2O$ | | | | | | 2.3 | |
| 25% $H_2SiF_6$ in $H_2O$ | 25 | 25 | 25 | 10 | 30 | | 30 |
| 70% HF in $H_2O$ | 4 | 4 | 4 | 4 | | 4 | 3.4 |
| 70% $HNO_3$ in $H_2O$ | | | | | | 15 | |
| Free acid points in 6.0% solution of the concentrate in $H_2O$: | 12.6 | 12.3 | 11.6 | 5.5 | 8.8 | 5.4 | 3.6 |
| Total acid points in 6.0% solution of the concentrate in $H_2O$: | 35.7 | 34.8 | 33.9 | 16.9 | 23.5 | 19.1 | 21.4 |

Note for Table 1
ACCUMER TM 1510, formerly known as ACRYSOLY TM A-1, is a commercial product of Rohm & Haas, reported by its supplier to be a poly{acrylic acid} polymer with a molecular weight of about 60,000.

WORKING COMPOSITIONS AND PROCESSES AND COMPARISONS

The first six concentrate compositions shown in Table 1 were diluted with tap water to provide working compositions as described in Table 2 below. In each case, the concentrate shown in Table 1 with the same numerical portion of its number as the working concentration number shown in Table 2 was used. Cold rolled steel and galvanized steel panels were phosphated with the resulting working compositions, adjusted to have a free acid value within the range from 0.1 to 0.6 points, at 48.9° to 54.4° C. for 90 seconds or 120 seconds. With compositions that were the same, except for addition of more fluoride, aluminum panels were also phosphated. In all cases, conversion coatings that were, judged by visual appearance and microscopic examination of the conversion coatings produced, at least as high in quality and as uniform as those obtained under the same conditions with a phosphating composition, including separately added nitrite ion accelerator, that was prepared according to the manufacturer's directions from BONDERITE TM 952, a commercial zinc-nickel-manganese phosphating make-up concentrate composition available from the Parker+Amchem Division of Henkel Corp., Madison Heights, Mich.

TABLE 2

SOME WORKING COMPOSITIONS ACCORDING TO THE INVENTION

| | Working Composition Number: | | | | | |
|---|---|---|---|---|---|---|
| | 1W | 2W | 3W | 4W | 5W | 6W |
| Concentration of Concentrate Composition in Working Composition, %: | 4.8 | 4.8 | 6.0 | 6.0 | 6.0 | 4.8 |

The invention claimed is:

1. An aqueous liquid make-up concentrate composition suitable for dilution with water to form a working phosphate conversion coating composition, said concentrate composition consisting essentially of water and the following dissolved components wherein amounts are based on the total composition:

(A) from about 150 to about 825 g/kg of phosphate ions;

(B) zinc cations in such an amount that the ratio of phosphate ions to zinc ions is within the range from about 3:1 to about 100:1;

(C) at least one of:

(C.1) from about 0.10 to about 300 g/kg of internal accelerator selected from the group consisting of reducing sugars, starch, and urea;

(C.2) from about 0.0005 to about 1.0 g/kg of acrylate or methacrylate polymers; and (D) an amount of acid such that a solution of 6.0% of the concentrate in deionized water will have from about 1.0 to about 40 points of free acid and from about 3.5 to 70 points of total acid; and, optionally, (E) an amount of manganese (II) cations such that the ratio of the manganese cations to the zinc cations is within the range from about 1:10 to 5:1; and, optionally, (F) at least one of:

(F.1) an amount of divalent cations selected from the group consisting of nickel, cobalt, and magnesium cations such that the ratio of the total of these divalent cations to the zinc cations is within the range from about 1:5 to 5:1;

(F.2) an amount of divalent copper cations such that the ratio of the copper cations to the zinc cations is within the range from about 0.0025:5 to about 0.5:1; and, optionally, (G) from about 1.0 to about 50 g/kg of complex fluoride ions; and, optionally, (H) from about 0.4 to about 20 g/kg of fluoride ions derived from the group consisting of hydrofluoric acid and alkali metal and ammonium fluorides and bifluorides; and, optionally, (J) not more than 200 g/kg of nitrate ions.

2. A concentrate composition according to claim 1, consisting essentially of water and the following dissolved components:

(A) from about 200 to about 700 g/kg of phosphate ions;

(B) zinc cations in such an amount that the ratio of phosphate ions to zinc ions is within the range from about 5:1 to about 50:1;

(C) at least one of:

(C.1) from about 0.25 to about 200 g/kg of internal accelerator selected from the group consisting of reducing sugars, starch, and urea;

(C.2) from about 0.0005 to about 0.5 g/kg of acrylate or methacrylate polymers; and (D) an amount of acid such that a solution of 6.0% of the concentrate in deionized water will have from about 2.5 to about 34 points of free acid and from about 3.0 to 57 points of total acid; and, optionally, (E) an amount of manganese (II) cations such that the ratio of the manganese cations to the zinc cations is within the range from about 1.0:7.0 to about 3.0:1.0; and, optionally, (F) at least one of:

(F.1) an amount of divalent cations selected from the group consisting of nickel, cobalt, and magnesium cations such that the ratio of the total of these divalent cations to the zinc cations is within the range from about 1.0:4.0 to 3.0:1.0;

(F.2) an amount of divalent copper cations such that the ratio of the copper cations to the zinc cations is within the range from about 0.0030:4.0 to about 0.30:1; and, optionally, (G) from about 1.5 to about 21 g/kg of complex fluoride ions; and, optionally, (H) from about 1.1 to about 10 g/kg of fluoride ions derived from the group consisting of hydrofluoric acid and alkali metal and ammonium fluorides and bifluorides; and, optionally, (J) not more than 100 g/kg of nitrate ions.

3. A concentrate composition according to claim 2, consisting essentially of water and the following dissolved components:

(A) from about 220 to about 600 g/kg of phosphate ions;

(B) zinc cations in such an amount that the ratio of phosphate ions to zinc ions is within the range from about 7.0:1.0 to 35:1;

(C) at least one of:

(C.1) from about 0.30 to about 200 g/kg of internal accelerator selected from the group consisting of reducing sugars, starch, and urea;

(C.2) from about 0.0005 to about 0.20 g/kg of acrylate or methacrylate polymers; and (D) an amount of acid such that a solution of 6.0% of the concentrate in deionized water will have from about 3.5 to about 29 points of free acid and from about 10 to about 42 points of total acid; and, optionally, (E) an amount of manganese (II) cations such that the ratio of the manganese cations to the zinc cations is within the range from about 1.0:4.0 to about 1.5:1.0; and, optionally, (F) at least one of:

(F.1) an amount of divalent cations selected from the group consisting of nickel, cobalt, and magnesium cations such that the ratio of the total of these divalent cations to the zinc cations is within the range from about 1.0:2.0 to 1.8:1.0;

(F.2) an amount of divalent copper cations such that the ratio of the copper cations to the zinc cations is within the range from about 0.004:2.0 to 0.18:1.0; and, optionally, (G) from about 1.9 to about 17 g/kg of complex fluoride ions; and, optionally, (H) from about 1.7 to about 6 g/kg of fluoride ions derived from the group consisting of hydrofluoric acid and alkali metal and ammonium fluorides and bifluorides; and, optionally, (J) not more than 85 g/kg of nitrate ions.

4. A concentrate composition according to claim 3, consisting essentially of water and the following dissolved components:

(A) from about 235 to about 500 g/kg of phosphate ions;

(B) zinc cations in such an amount that the ratio of phosphate ions to zinc ions is within the range from about 8.5:1 to about 20:1;

(C) at least one of:

(C.1) from about 0.38 to about 200 g/kg of internal accelerator selected from the group consisting of reducing sugars, starch, and urea;

(C.2) from about 0.0005 to about 0.20 g/kg of acrylate or methacrylate polymers; and (D) an amount of acid such that a solution of 6.0% of the concentrate in deionized water will have from about 4.3 to about 25 points of free acid and from about 13 to 42 points of total acid; and, optionally, (E) an amount of manganese (II) cations such that the ratio of the manganese cations to the zinc cations is within the range from about 1.0:4.0 to about 3.0:1.0; and, optionally, (F) at least one of:

(F.1) an amount of divalent cations selected from the group consisting of nickel, cobalt, and magnesium cations such that the ratio of the total of these divalent cartons to the zinc cations is within the range from about 1.0:4.0 to about 3.0:1.0;

(F.2) an amount of divalent copper cations such that the ratio of the copper cations to the zinc cations is within the range from about 0.004:2.0 to 0.18:1; and, optionally, (G) from about 2.2 to about 14 g/kg of complex fluoride ions; and, optionally, (H) from about 2.0 to about 4.6 g/kg of fluoride ions derived from the group consisting of hydrofluoric acid and alkali metal and ammonium fluorides and bifluorides; and, optionally, (J) not more than 70 g/kg of nitrate ions.

5. A concentrate composition according to claim 4, consisting essentially of water and the following dissolved components:

(A) from about 245 to about '450 g/kg of phosphate ions;

(B) zinc cations in such an amount that the ratio of phosphate ions to zinc ions is within the range from about 10.0:1.0 to 14:1;

(C) at least one of:

(C.1) from about 1.0 to about 175 g/kg of internal accelerator selected from the group consisting of reducing sugars, starch, and urea;

(C.2) from about 0.0005 to about 0.07 g/kg of acrylate or methacrylate polymers; and (D) an amount of acid such that a solution of 6.0% of the concentrate in deionized water will have from about 5.0 to about 22 points of free acid and from about 15 to about 39 points of total acid; and, optionally, (E) an amount of manganese (II) cations such that the ratio of the manganese cations to the zinc cations is within the range from about 1.0:2.4 to 1.0:1.0; and, optionally, (F) at least one of:

(F.1) an amount of divalent cations selected from the group consisting of nickel, cobalt, and magnesium cations such that the ratio of the total of these divalent cations to the zinc cations is within the range from about 1.0:1.4 to 1.2:1.0;

(F.2) an amount of divalent copper cations such that the ratio of the copper cations to the zinc cations is within the range from about 0.010:1.4 to 0.12:1.0; and, optionally, (G) from about 2.4 to about 11 g/kg of complex fluoride ions; and, optionally, (H) from about 2.2 to about 3.9 g/kg of fluoride ions derived from the group consisting of hydrofluoric acid and alkali metal and ammonium fluorides and bifluorides; and, optionally, (J) not more than 60 g/kg of nitrate ions.

6. A concentrate composition according to claim 5, consisting essentially of water and the following dissolved components:

(A) from about 245 to about 450 g/kg of phosphate ions;

(B) zinc cations in such an amount that the ratio of phosphate ions to zinc ions is within the range from about 11.0:1.0 to about 14:1;

(C) from about 4.0 to about 175 g/kg of internal accelerator selected from the group consisting of reducing sugars, starch, and urea;

(D) an amount of acid such that a solution of 6.0% of the concentrate in deionized water will have from about 5.3 to about 20 points of free acid and from about 16.5 to 37 points of total acid; and (E) an amount of manganese (II) cations such that the ratio of the manganese cations to the zinc cations is within the range from about 1.0:2.4 to about 1.0:1.0; and, optionally, (F) at least one of:

(F.1) an amount of divalent cations selected from the group consisting of nickel, cobalt, and magnesium cations such that the ratio of the total of these divalent cations to the zinc cations is within the range from about 1.0:1.4 to 1.2:1.0;

(F.2) an amount of divalent copper cations such that the ratio of the copper cations to the zinc cations is within the range from about 0.010:1.4 to about 0.12:1.0; and, optionally, (G) from about 2.4 to about 9.3 g/kg of complex fluoride ions; and, optionally, (H) from about 2.4 to about 3.4 g/kg of fluoride ions derived from the group consisting of hydrofluoric acid and alkali metal and ammonium fluorides and bifluorides; and, optionally, (J) not more than 55 g/kg of nitrate ions.

7. A concentrate composition according to claim 6, consisting essentially of water and the following dissolved components:

(A) from about 245 to about 450 g/kg of phosphate ions;

(B) zinc cations in such an amount that the ratio of phosphate ions to zinc ions is within the range from about 11.0:1.0 to about 14:1;

(C) from about 8.0 to about 175 g/kg of internal accelerator selected from the group consisting of reducing sugars, starch, and urea;

(D) an amount of acid such that a solution of 6.0% of the concentrate in deionized water will have from about 5.3 to about 18 points of free acid and from about 16.5 to 36 points of total acid;

(E) an amount of manganese (II) cations such that the ratio of the manganese cations to the zinc cations is within the range from about 1.0:2.4 to about 1.0:1.0; and (F) at least one of:

(F.1) an amount of divalent cations selected from the group consisting of nickel, cobalt, and magnesium cations such that the ratio of the total of these divalent cations to the zinc cations is within the range from about 1.0:1.4 to 1.2:1.0;

(F.2) an amount of divalent copper cations such that the ratio of the copper cations to the zinc cations is within the range from about 0.010:1.4 to about 0.12:1.0; and, optionally, (G) from 2.4 to 7.5 g/kg of complex fluoride ions; and, optionally, (H) from 2.6 to 3.1 g/kg of fluoride ions derived from the group consisting of hydrofluoric acid and alkali metal and ammonium fluorides and bifluorides; and, optionally, (J) not more than 55 g/kg of nitrate ions.

8. A concentrate composition according to claim 7, consisting essentially of water and the following dissolved components:

(A) from about 245 to about 450 g/kg of phosphate ions;

(B) zinc cations in such an amount that the ratio of phosphate ions to zinc ions is within the range from about 11.0:1.0 to about 14:1;

(C) from about 16.0 to about 175 g/kg of internal accelerator selected from the group consisting of reducing sugars and urea, including at least about 16.0 g/kg selected from the group consisting of dextrose and galactose;

(D) an amount of acid such that a solution of 6.0% of the concentrate in deionized water will have from about 5.3 to about 16 points of free acid and from about 16.5 to 36 points of total acid;

(E) an amount of manganese (II) cations such that the ratio of the manganese cations to the zinc cations is within the range from about 1.0:2.4 to about 1.0:1.0; and (F) at least one of:

(F.1) an amount of divalent cations selected from the group consisting of nickel, cobalt, and magnesium cations such that the ratio of the total of these divalent cations to the zinc cations is within the range from about 1.0:1.4 to about 1.2:1.0;

(F.2) an amount of divalent copper cations such that the ratio of the copper cations to the zinc cations is within the range from about 0.010:1.4 to about 0.12:1.0;

(G) from about 2.4 to about 7.5 g/kg of complex fluoride ions, including at least about 2.2 g/kg of fluosilicate ions; and (H) from about 2.6 to about 3.1 g/kg of fluoride ions derived from the group consisting of hydrofluoric acid and alkali metal and ammonium fluorides and bifluorides; and, optionally, (J) not more than 50 g/kg of nitrate ions.

9. A concentrate composition according to claim 8, consisting essentially of water and the following dissolved components:

(A) from about 245 to about 450 g/kg of phosphate ions;

(B) zinc cations in such an amount that the ratio of phosphate ions to zinc ions is within the range from about 11.0:1.0 to about 14:1;

(C) from about 25 to about 175 g/kg of internal accelerator selected from the group consisting of reducing sugars, including at least about 30 g/kg selected from the group consisting of dextrose and galactose;

(D) an amount of acid such that a solution of 6.0% of the concentrate in deionized water will have from about 5.3 to about 13.5 points of free acid and from 16.5 to 36 points of total acid;

(E) an amount of manganese (II) cations such that the ratio of the manganese cations to the zinc cations is within the range from about 1.0:2.4 to about 1.0:1.0; and (F) at least one of:

(F.1) an amount of divalent cations selected from the group consisting of nickel, cobalt, and magnesium cations such that the ratio of the total of these divalent cations to the zinc cations is within the range from about 1.0:1.4 to about 1.2:1.0;

(F.2) an amount of divalent copper cations such that the ratio of the copper cations to the zinc cations is within the range from about 0.010:1.4 to about 0.12:1.0;

(G) from about 2.4 to about 7.5 g/kg of complex fluoride ions selected from the group consisting of fluosilicate, fluotitanate, fluoborate, and fluozirconate ions, including at least about 2.4 g/kg of fluosilicate ions; and (H) from 2.7 to about 2.9 g/kg of fluoride ions derived from the group consisting of hydrofluoric acid; and, optionally, (J) not more than 50 g/kg of nitrate ions.

10. A working phosphate conversion coating composition made by diluting a concentrate composition according to claim 9 with water only to produce a working coating composition containing from about 3.4 to about 6.2% of the concentrate composition.

11. A working phosphate conversion coating composition made by diluting a concentrate composition according to claim 1 with water only to produce a working coating composition containing from about 0.5 to about 20% of the concentrate composition.

12. A process of forming a phosphate conversion coating on a metal substrate by contacting it with a working coating composition according to claim 11.

13. An aqueous liquid replenisher concentrate composition, said concentrate composition consisting essentially of water and the following dissolved components wherein amounts are based on the total composition:

(A) from about 150 to about 825 g/kg of phosphate ions;

(B) zinc cations in such an amount that the ratio of phosphate ions to zinc ions is within the range from about 1:1 to about 35:1;

(C) at least one of:

(C.1) from about 0.10 to about 300 g/kg of internal accelerator selected from the group consisting of reducing sugars, starch, and urea;

(C.2) from about 0.0005 to about 1.0 g/kg of acrylate or methacrylate polymers; and (D) an amount of acid such that a solution of 6.0% of the concentrate in deionized water will have from about 1.0 to about 10 points of free acid and from about 3.5 to 70 points of total acid; and, optionally, (E) an amount of manganese (II) cations such that the ratio of the manganese cations to the zinc cations is within the range from about 1:10 to 2:1; and, optionally, (F) at least one of:

(F.1) an amount of divalent cations selected from the group consisting of nickel, cobalt, and magnesium cations such that the ratio of the total of these divalent cations to the zinc cations is within the range from about 0.05:1 to 1.5:1;

(F.2) an amount of divalent copper cations such that the ratio of the copper cations to the zinc cations is within the range from about 0.0025:5 to about 0.5:1; and, optionally, (G) from about 1.0 to about 50 g/kg of complex fluoride ions; and, optionally, (H) from about 0.4 to about 20 g/kg of fluoride ions derived from the group consisting of hydrofluoric acid and alkali metal and ammonium fluorides and bifluorides; and, optionally, (J) not more than 200 g/kg of nitrate ions.

14. A replenisher concentrate composition according to claim 13, consisting essentially of water and the following dissolved components:

(A) from about 220 to about 600 g/kg of phosphate ions;

(B) zinc cations in such an amount that the ratio of phosphate ions to zinc ions is within the range from about 3.0:1.0 to 14:1;

(C) at least one of:

(C.1) from about 0.38 to about 80 g/kg of internal accelerator selected from the group consisting of reducing sugars, starch, and urea;

(C.2) from about 0.0005 to about 0.20 g/kg of acrylate or methacrylate polymers; and (D) an amount of acid such that a solution of 6.0% of the concentrate in deionized water will have from about 1.0 to about 5.5 points of free acid and from about 10 to about 42 points of total acid; and, optionally, (E) an amount of manganese (II) cations such that the ratio of the manganese cations to the zinc cations is within the range from about 1:10 to about 2:1; and, optionally, (F) at least one of:

(F.1) an amount of divalent cations selected from the group consisting of nickel, cobalt, and magnesium cations such that the ratio of the total of these divalent cations to the zinc cations is within the range from about 0.05:1.0 to 1.5:1.0;

(F.2) an amount of divalent copper cations such that the ratio of the copper cations to the zinc cations is within the range from about 0.004:2.0 to 0.18:1.0; and, optionally, (G) from about 1.9 to about 17 g/kg of complex fluoride ions; and, optionally, (H) from about 1.3 to about 6 g/kg of fluoride ions derived from the group consisting of hydrofluoric acid and alkali metal and ammonium fluorides and bifluorides; and, optionally, (J) not more than 85 g/kg of nitrate ions.

15. A replenisher concentrate composition according to claim 14, consisting essentially of water and the following dissolved components:

(A) from about 235 to about 500 g/kg of phosphate ions;

(B) zinc cations in such an amount that the ratio of phosphate ions to zinc ions is within the range from about 3.0:1.0 to about 9.0:1.0;

(C) at least one of:

(C.1) from about 1.0 to about 40 g/kg of internal accelerator selected from the group consisting of reducing sugars, starch, and urea;

(C.2) from about 0.0005 to about 0.20 g/kg of acrylate or methacrylate polymers; and (D) an amount of acid such that a solution of 6.0% of the concentrate in deionized water will have from about 1.8 to about 5.1 points of free acid and from about 13 to 42 points of total acid; and, optionally, (E) an amount of manganese (II) cations such that the ratio of the manganese cations to the zinc cations is within the range from about 1.0:10 to about 2:1.0; and, optionally, (F) at least one of:

(F.1) an amount of divalent cations selected from the group consisting of nickel, cobalt, and magnesium cations such that the ratio of the total of these divalent cations to the zinc cations is within the range from about 0.05:1.0 to about 1.5:1.0;

(F.2) an amount of divalent copper cations such that the ratio of the copper cations to the zinc cations is within the range from about 0.004:2.0 to 0.18:1; and, optionally, (G) from about 2.2 to about 14 g/kg of complex fluoride ions; and, optionally, (H) from about 1.6 to about 4.2 g/kg of fluoride ions derived from the group consisting of hydrofluoric acid and alkali metal and ammonium fluorides and bifluorides; and, optionally, (J) not more than 70 g/kg of nitrate ions.

16. A replenisher concentrate composition according to claim 15, consisting essentially of water and the following dissolved components:

(A) from about 245 to about 450 g/kg of phosphate ions;

(B) zinc cations in such an amount that the ratio of phosphate ions to zinc ions is within the range from about 3.0.0:1.0 to 9.0:1;

(C) at least one of:

(C.1) from about 4.0 to about 25 g/kg of internal accelerator selected from the group consisting of reducing sugars, starch, and urea;

(C.2) from about 0.0005 to about 0.07 g/kg of acrylate or methacrylate polymers; and (D) an amount of acid such that a solution of 6.0% of the concentrate in deionized water will have from about 1.8 to about 4.7 points of free acid and from about 15 to about 39 points of total acid; and, optionally, (E) an amount of manganese (II) cations such that the ratio of the manganese cations to the zinc cations is within the range from about 1.0:10 to 2.0:1.0; and, optionally, (F) at least one of:

(F.1) an amount of divalent cations selected from the group consisting of nickel, cobalt, and magnesium cations such that the ratio of the total of these divalent cations to the zinc cations is within the range from about 0.07:1.4 to 0.8:1.0;

(F.2) an amount of divalent copper cations such that the ratio of the copper cations to the zinc cations is within the range from about 0.010:1.4 to 0.12:1.0; and, optionally, (G) from about 2.4 to about 11 g/kg of complex fluoride ions; and, optionally, (H) from about 1.8 to about 3.5 g/kg of fluoride ions derived from the group consisting of hydrofluoric acid and alkali metal and ammonium fluorides and bifluorides; and, optionally, (J) not more than 60 g/kg of nitrate ions.

17. A replenisher concentrate composition according to claim 16, consisting essentially of water and the following dissolved components:

(A) from about 245 to about 450 g/kg of phosphate ions;

(B) zinc cations in such an amount that the ratio of phosphate ions to zinc ions is within the range from about 3.5.0:1.0 to about 7.5:1;

(C) from about 6.7 to about 20 g/kg of internal accelerator selected from the group consisting of reducing sugars, starch, and urea;

(D) an amount of acid such that a solution of 6.0% of the concentrate in deionized water will have from about 2.5 to about 4.4 points of free acid and from about 16.5 to 37 points of total acid; and (E) an amount of manganese (II) cations such that the ratio of the manganese cations to the zinc cations is within the range from about 1.0:7.0 to about 1.0:1.0; and, optionally, (F) at least one of:

(F.1) an amount of divalent cations selected from the group consisting of nickel, cobalt, and magnesium cations such that the ratio of the total of these divalent cations to the zinc cations is within the range from about 0.07:1.4 to 0.8:1.0;

(F.2) an amount of divalent copper cations such that the ratio of the copper cations to the zinc cations is within the range from about 0.010:1.4 to about 0.12:1.0; and, optionally, (G) from about 2.4 to about 9.3 g/kg of complex fluoride ions; and, optionally, (H) from about 2.0 to about 3.0 g/kg of fluoride ions derived from the group consisting of hydrofluoric acid and alkali metal and ammonium fluorides and bifluorides; and, optionally, (J) not more than 55 g/kg of nitrate ions.

18. A replenisher concentrate composition according to claim 17, consisting essentially of water and the following dissolved components:

(A) from about 245 to about 450 g/kg of phosphate ions;

(B) zinc cations in such an amount that the ratio of phosphate ions to zinc ions is within the range from about 4.3:1.0 to about 6.5:1;

(C) from about 8.4 to about 16 g/kg of internal accelerator selected from the group consisting of reducing sugars, starch, and urea;

(D) an amount of acid such that a solution of 6.0% of the concentrate in deionized water will have from about 2.9 to about 4.2 points of free acid and from about 16.5 to 36 points of total acid;

(E) an amount of manganese (II) cations such that the ratio of the manganese cations to the zinc cations is within the range from about 1.0:7.0 to about 1.0:1.0; and (F) at least one of:

(F.1) an amount of divalent cations selected from the group consisting of nickel, cobalt, and magnesium cations such that the ratio of the total of these divalent cations to the zinc cations is within the range from about 0.10:1.4 to 0.4:1.0;

(F.2) an amount of divalent copper cations such that the ratio of the copper cations to the zinc cations is within the range from about 0.010:1.4 to about 0.12:1.0; and, optionally, (G) from 2.4 to 7.5 g/kg of complex fluoride ions; and, optionally, (H) from 2.2 to 2.7 g/kg of fluoride ions derived from the group consisting of hydrofluoric acid and alkali metal and ammonium fluorides and bifluorides; and, optionally, (J) not more than 55 g/kg of nitrate ions.

19. A replenisher concentrate composition according to claim 18, consisting essentially of water and the following dissolved components:

(A) from about 245 to about 450 g/kg of phosphate ions;

(B) zinc cations in such an amount that the ratio of phosphate ions to zinc ions is within the range from about 4.3:1.0 to about 5.8:1;

(C) from about 9.5 to about 13 g/kg of internal accelerator selected from the group consisting of reducing sugars and urea, including at least about 16.0 g/kg selected from the group consisting of dextrose and galactose;

(D) an amount of acid such that a solution of 6.0% of the concentrate in deionized water will have from about 3.2 to about 4 points of free acid and from about 16.5 to 36 points of total acid;

(E) an amount of manganese (II) cations such that the ratio of the manganese cations to the zinc cations is within the range from about 1.0:5 to about 0.75:1.0; and (F) at least one of:

(F.1) an amount of divalent cations selected from the group consisting of nickel, cobalt, and magnesium cations such that the ratio of the total of these divalent cations to the zinc cations is within the range from about 0.12:1.0 to about 0.28:1.0;

(F.2) an amount of divalent copper cations such that the ratio of the copper cations to the zinc cations is within the range from about 0.010:1.4 to about 0.12:1.0;

(G) from about 2.4 to about 7.5 g/kg of complex fluoride ions, including at least about 2.2 g/kg of fluosilicate ions; and (H) from about 2.2 to about 2.7 g/kg of fluoride ions derived from the group consisting of hydrofluoric acid and alkali metal and ammonium fluorides and bifluorides; and, optionally, (J) not more than 50 g/kg of nitrate ions.

20. A replenisher concentrate composition according to claim 19, consisting essentially of water and the following dissolved components:

(A) from about 245 to about 450 g/kg of phosphate ions;

(B) zinc cations in such an amount that the ratio of phosphate ions to zinc ions is within the range from about 4.9:1.0 to about 5.4:1.0;

(C) from about 9.7 to about 11 g/kg of internal accelerator selected from the group consisting of dextrose and galactose;

(D) an amount of acid such that a solution of 6.0% of the concentrate in deionized water will have from about 3.4 to about 3.9 points of free acid and from 16.5 to 36 points of total acid;

(E) an amount of manganese (II) cations such that the ratio of the manganese cations to the zinc cations is within the range from about 1.0:4.0 to about 1.0:2.0; and (F) at least one of:

(F.1) an amount of divalent cations selected from the group consisting of nickel, cobalt, and magnesium cations such that the ratio of the total of these divalent cations to the zinc cations is within the range from about 0.16:1.0 to about 0.22:1.0;

(F.2) an amount of divalent copper cations such that the ratio of the copper cations to the zinc cations is within the range from about 0.010:1.4 to about 0.12:1.0;

(G) from about 2.4 to about 7.5 g/kg of complex fluoride ions selected from the group consisting of fluosilicate, fluotitanate, fluoborate, and fluozirconate ions, including at least about 2.4 g/kg of fluosilicate ions; and (H) from 2.3 to about 2.5 g/kg of fluoride ions derived from the group consisting of hydrofluoric acid; and, optionally, (J) not more than 50 g/kg of nitrate ions.

* * * * *